US005967323A

United States Patent [19]

Siragusa

[11] Patent Number: 5,967,323

[45] Date of Patent: Oct. 19, 1999

[54] PORTABLE CUPCAKE RIDDLE

[76] Inventor: Sussan Siragusa, 6 Taurgo La., Centereach, N.Y. 11720

[21] Appl. No.: 09/105,428

[22] Filed: Jun. 26, 1998

[51] Int. Cl.[6] ..... B65D 21/00

[52] U.S. Cl. ..... 206/499; 206/509; 206/562; 220/212.5; 220/780

[58] Field of Search ..... 206/551, 541, 206/499, 509, 511, 562, 467; 220/212.5, 780, 4.27, 507, 502, 516, 573.1, 912; 426/113, 119, 128; 229/906

[56] References Cited

U.S. PATENT DOCUMENTS

| | | | |
|---|---|---|---|
| 1,727,087 | 9/1929 | Wendle | 220/212.5 |
| 2,050,980 | 8/1936 | Buhl | 220/516 |
| 2,627,996 | 2/1953 | Dorner | 220/212.5 |
| 2,718,980 | 9/1955 | Strom | 220/780 |
| 2,895,654 | 7/1959 | Rieke | 220/212.5 |
| 3,072,250 | 1/1963 | Houston | 206/551 |
| 3,160,306 | 12/1964 | Smalley | 220/512 |
| 3,307,603 | 3/1967 | Swett | 206/551 |
| 3,516,596 | 6/1970 | Madden et al. | 229/906 |
| 4,197,940 | 4/1980 | DeRossett | 206/551 |
| 4,694,961 | 9/1987 | Mendendez | 206/508 |
| 4,705,163 | 11/1987 | James | 206/551 |
| 5,769,267 | 6/1998 | Duynslager et al. | 220/780 |
| 5,794,783 | 8/1998 | Carter | 206/725 |

*Primary Examiner*—Paul T. Sewell
*Assistant Examiner*—Nhan T. Lam

[57] ABSTRACT

A cup cake riddle is provided including a base having a plurality of circular cut outs formed therein for supporting cup cakes therein. Next provided is a cover for releasably securing over the base to afford a hermetically sealed compartment in which the cup cakes reside. A handle is rotatably coupled to the cover for carrying purposes.

16 Claims, 2 Drawing Sheets

PORTABLE CUPCAKE RIDDLE

BACKGROUND OF THE INVENTION

1. Field of the Invention

The present invention relates to cup cake pans and more particularly pertains to a new portable cup cake riddle for transporting a large number of cup cakes while preserving the freshness thereof.

2. Description of the Prior Art

The use of cup cake pans is known in the prior art. More specifically, cup cake pans heretofore devised and utilized are known to consist basically of familiar, expected and obvious structural configurations, notwithstanding the myriad of designs encompassed by the crowded prior art which have been developed for the fulfillment of countless objectives and requirements.

Known prior art cup cake pans include U.S. Pat. Des. No. 348,378; U.S. Pat. No. 5,207,150; U.S. Pat. No. 4,694,961; U.S. Pat. No. 4,154,795; U.S. Pat. No. 5,287,959; and U.S. Pat. No. 5,450,785.

In these respects, the portable cup cake riddle according to the present invention substantially departs from the conventional concepts and designs of the prior art, and in so doing provides an apparatus primarily developed for the purpose of transporting a large number of cup cakes while preserving the freshness thereof.

SUMMARY OF THE INVENTION

In view of the foregoing disadvantages inherent in the known types of cup cake pans now present in the prior art, the present invention provides a new portable cup cake riddle construction wherein the same can be utilized for transporting a large number of cup cakes while preserving the freshness thereof.

The general purpose of the present invention, which will be described subsequently in greater detail, is to provide a new portable cup cake riddle apparatus and method which has many of the advantages of the cup cake pans mentioned heretofore and many novel features that result in a new portable cup cake riddle which is not anticipated, rendered obvious, suggested, or even implied by any of the prior art cup cake pans, either alone or in any combination thereof.

To attain this, the present invention generally comprises a base having a generally square configuration. As shown in FIG. 1, the base is equipped with a bottom face and a peripheral side wall integrally coupled to a periphery of the bottom face and extending upwardly therefrom. As such, an interior space and an upper peripheral edge is defined. For reasons that will soon become apparent, the peripheral side wall has an outer surface with a peripheral groove formed therein. The peripheral groove preferably is formed about an entire periphery of the base and further resides within a common horizontal plane. The base also includes a horizontally oriented top face integrally coupled to the side wall of the base adjacent to and spaced from the upper peripheral edge thereof. By this structure, a square recess is defined. The top face includes a matrix of circular cut outs formed therein. The bottom face of the base remains in parallel relationship with the top face of the base for supporting cup cakes situated within the cut outs during use. Next provided is a plurality of trays each including a square top face with a matrix of circular cut outs formed therein. A pair of diagonally opposed L-shaped protrusions are integrally coupled to the top face and extend upwardly therefrom. Coupled to corners of the trays are four legs each having a constant L-shaped horizontal cross-section and a slot formed therein. Note FIG. 2. A planar square plate is removably situated within the slot of each leg such that the plate remains in parallel relationship with the top face. The plate thus functions for supporting cup cakes situated within the cut outs of the corresponding tray. In use, the legs of each tray may be secured to the L-shaped protrusions of another tray situated thereunder. Further, the legs of a bottommost tray are situated within the recess of the base. Also included is a cover having a square top face and a side wall integrally coupled to a periphery of the top face of the cover. Such side wall depends downwardly from the top face of the cover for defining an interior space, open bottom and lower peripheral edge. As shown in FIG. 2, the cover includes a peripheral protrusion integrally formed in an interior surface of the side wall. Such peripheral protrusion resides adjacent to the lower peripheral edge for releasably coupling with the peripheral groove of the base when situated over the stacked strays. As such, a hermetically sealed compartment is provided in which the cup cakes may be situated. Finally, a handle is provided having an inverted U-shaped configuration. The handle has a pair of ends rotatably coupled to opposed sides of the side wall of the cover adjacent to the lower peripheral edge thereof for carrying purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new portable cup cake riddle apparatus and method which has many of the advantages of the cup cake pans mentioned heretofore and many novel features that result in a new portable cup cake riddle which is not anticipated, rendered obvious, suggested, or even implied by any of the prior art cup cake pans, either alone or in any combination thereof.

It is another object of the present invention to provide a new portable cup cake riddle which may be easily and efficiently manufactured and marketed.

It is a further object of the present invention to provide a new portable cup cake riddle which is of a durable and reliable construction.

An even further object of the present invention is to provide a new portable cup cake riddle which is susceptible of a low cost of manufacture with regard to both materials and labor, and which accordingly is then susceptible of low prices of sale to the consuming public, thereby making such portable cup cake riddle economically available to the buying public.

Still yet another object of the present invention is to provide a new portable cup cake riddle which provides in the apparatuses and methods of the prior art some of the advantages thereof, while simultaneously overcoming some of the disadvantages normally associated therewith.

Still another object of the present invention is to provide a new portable cup cake riddle for transporting a large number of cup cakes while preserving the freshness thereof.

Even still another object of the present invention is to provide a new portable cup cake riddle that includes a base having a plurality of circular cut outs formed therein for supporting cup cakes therein. Next provided is a cover for releasably securing over the base to afford a hermetically sealed compartment in which the cup cakes reside. A handle is rotatably coupled to the cover for carrying purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
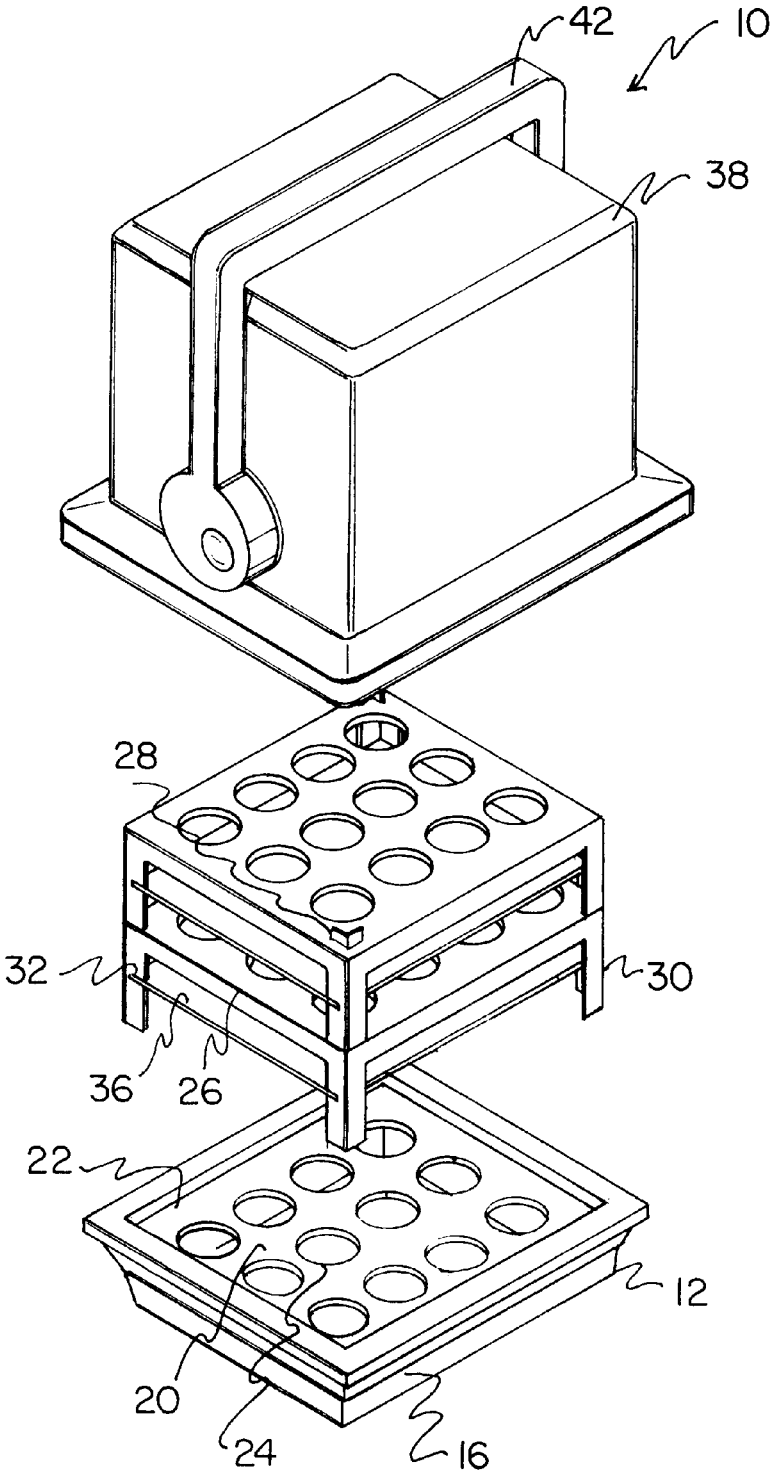
FIG. 1 is a perspective view of a new portable cup cake riddle according to the present invention.
Figure 2:
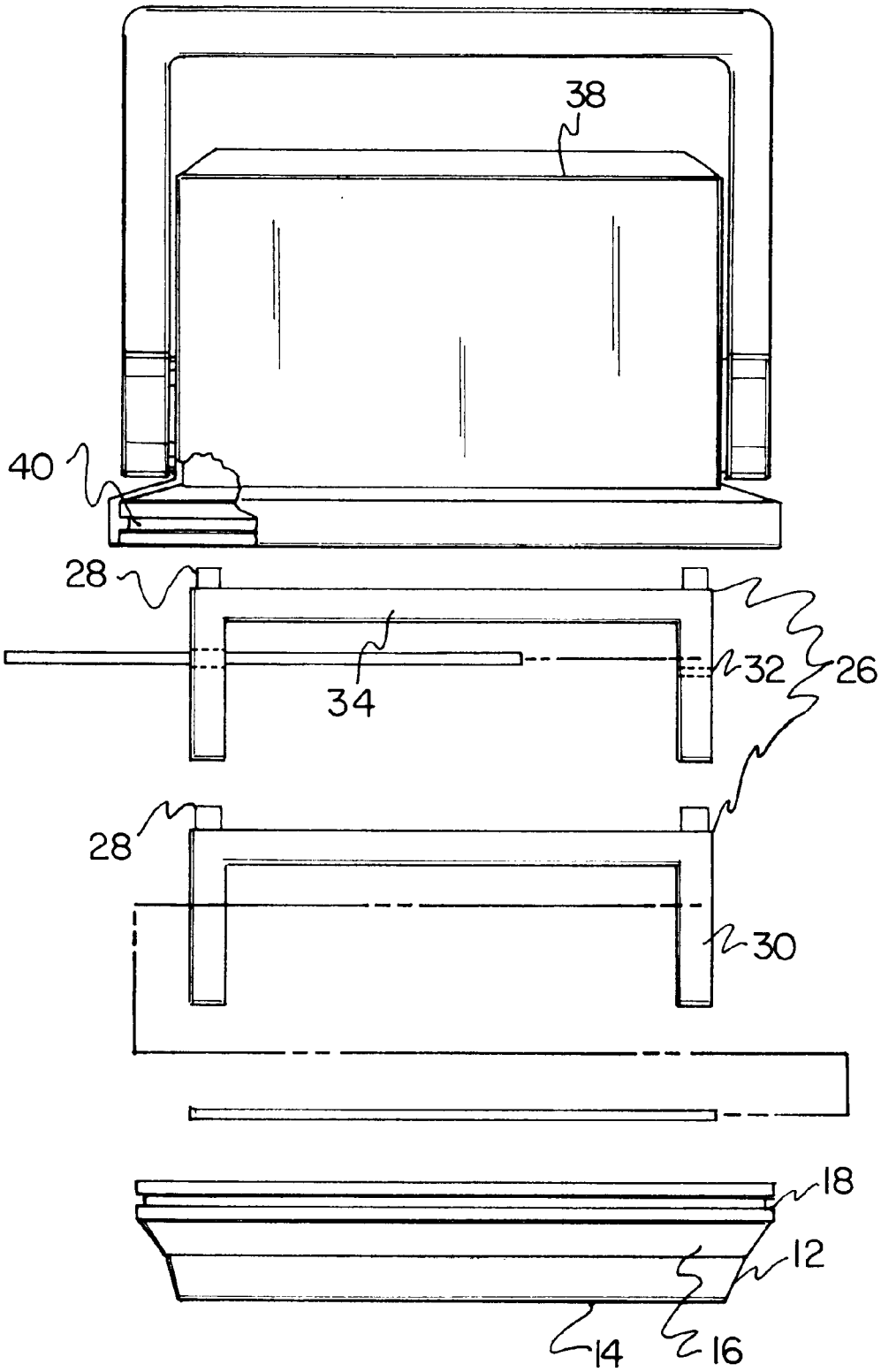
FIG. 2 is a side exploded view of the present invention.

With reference now to the drawings, and in particular to FIGS. 1 through 2 thereof, a new portable cup cake riddle embodying the principles and concepts of the present invention and generally designated by the reference numeral 10 will be described.

The present invention, designated as numeral 10, includes a base 12 having a generally square configuration. As shown in FIG. 1, the base is equipped with a bottom face 14 and a peripheral side wall 16 integrally coupled to a periphery of the bottom face and extending upwardly therefrom. As such, an interior space and an upper peripheral edge is defined. For reasons that will soon become apparent, the peripheral side wall has an outer surface with a peripheral groove 18 formed therein. The peripheral groove preferably is formed about an entire periphery of the base and further resides within a common horizontal plane.

The base also includes a horizontally oriented top face 20 integrally coupled to the side wall of the base adjacent to and spaced from the upper peripheral edge thereof. By this structure, an upper square recess 22 is defined. The top face includes a matrix of circular cut outs 24 formed therein. The bottom face of the base remains in parallel relationship with the top face of the base for supporting cup cakes situated within the cut outs during use.

Next provided is a plurality of trays 26 each including a square top face with a matrix of circular cut outs formed therein. A pair of diagonally opposed L-shaped protrusions 28 are integrally coupled to the top face and extend upwardly therefrom. Coupled to corners of the trays are four legs 30 each having a constant L-shaped horizontal cross-section and a slot 32 formed therein. Note FIG. 2. For strengthening purposes, a downwardly extending lip 34 is integrally coupled to a periphery of the top face of each tray.

A planar square plate 36 is removably situated within the slot of each leg such that the plate remains in parallel relationship with the top face. The plate thus functions for supporting cup cakes situated within the cut outs of the corresponding tray. In use, the legs of each tray may be secured to the L-shaped protrusions of another tray situated thereunder. Further, the legs of a bottommost tray are situated within the recess of the base.

Also included is a cover 38 having a square top face and a side wall integrally coupled to a periphery of the top face of the cover. Such side wall depends downwardly from the top face of the cover for defining an interior space, open bottom and lower peripheral edge. As shown in FIG. 2, the cover includes a peripheral protrusion 40 integrally formed in an interior surface of the side wall. Such peripheral protrusion resides adjacent to the lower peripheral edge for releasably coupling with the peripheral groove of the base when situated over the stacked strays. As such, a hermetically sealed compartment is provided in which the cup cakes may be situated. As shown in FIG. 2, an upper extent of the cover has a cross-sectional area equal to that of the trays. Further, a lower extent is enlarged to encompass an outer surface of the base. It should be noted that the cover and base may take various other shapes which are more rounded in design.

Finally, a handle 42 is provided having an inverted U-shaped configuration. The handle has a pair of ends rotatably coupled to opposed sides of the side wall of the cover adjacent to the lower peripheral edge thereof for carrying purposes. As shown in FIG. 2, an upper cross bar of the handle resides well above the cover when vertically oriented so that the same may be easily gripped. As an option, the handle may be secured to the base instead of the cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cup cake riddle comprising, in combination:

a base having a generally square configuration with a bottom face and a peripheral side wall integrally coupled to a periphery of the bottom face and extending upwardly therefrom for defining an interior space and an upper peripheral edge, the peripheral side wall having an outer surface with a peripheral groove formed therein about an entire periphery thereof and further residing within a common horizontal plane, the base further including a horizontally oriented top face integrally coupled to the side wall of the base adjacent to and spaced from the upper peripheral edge thereof, thereby defining a square recess, wherein the top face includes a matrix of circular cut outs formed therein and the bottom face of the base remains in parallel relationship with the top face of the base for supporting cup cakes situated within the cut outs;

a plurality of trays each including a square top face with a matrix of circular cut outs formed therein and a pair of diagonally opposed L-shaped protrusions integrally coupled to the top face and extending upwardly therefrom, four legs integrally coupled to corners of the trays and extending downwardly therefrom with each leg having a constant L-shaped horizontal cross-section and a slot formed therein, and a planar square plate removably situated within the slot of each leg such that the plate remains in parallel relationship with the top face for supporting cup cakes situated within the cut outs of the corresponding tray, wherein the legs of each tray may be secured to the L-shaped protrusions of another tray situated thereunder with the legs of a bottommost tray being situated within the recess of the base; and a cover including a square top face and a side wall integrally coupled to a periphery of the top face of the cover and depending downwardly therefrom for defining an interior space, open bottom and lower peripheral edge, the cover including a peripheral protrusion integrally formed in an interior surface of the side wall thereof adjacent to the lower peripheral edge for releasably coupling with the peripheral groove of the base when situated over the stacked strays, thereby affording a hermetically sealed compartment; and a handle having an inverted U-shaped configuration with a pair of ends rotatably coupled to opposed sides of the side wall of the cover adjacent to the lower peripheral edge thereof for carrying purposes.

2. A cup cake riddle comprising:

a base having a plurality of circular cut outs formed therein for supporting cup cakes therein;

a cover for releasably securing over the base, the cover including a peripheral protrusion for releasably coupling with a peripheral groove of the base when situated over the base, thereby affording a hermetically sealed compartment in which the cup cakes reside;

wherein at least one tray is situated on the base for supporting additional cup cakes, the tray having a plurality of legs coupled thereto towards corners of the tray; and a handle for carrying purposes.

3. A cup cake riddle as set forth in claim 2 wherein the handle is coupled to the cover.

4. A cup cake riddle as set forth in claim 2 wherein the handle is rotatably coupled to the riddle.

5. A cup cake riddle as set forth in claim 2 wherein the handle has a U-shaped configuration.

6. A cup cake riddle as set forth in claim 2 wherein a plurality of trays are included that are stacked within the base.

7. A cup cake riddle as set forth in claim 6 wherein each of the trays has a pair of diagonally opposed L-shaped protrusions integrally coupled to a top face thereof and extending upwardly therefrom, each leg having a constant L-shaped horizontal cross-section.

8. A cup cake riddle as set forth in claim 2 wherein the tray has a removable plate secured thereto for supporting the cup cakes.

9. A cup cake riddle as set forth in claim 2 wherein the peripheral protrusion of the cover is integrally formed in an interior surface of the side wall of the cover adjacent to the lower peripheral edge for releasably coupling with the peripheral groove of the base.

10. A cup cake riddle comprising:

a base having a bottom face and a peripheral side wall integrally coupled to a periphery of the bottom face and extending upwardly therefrom for defining an interior space and an upper peripheral edge, the peripheral side wall having an outer surface with a peripheral groove formed therein about an entire periphery thereof, the base having a plurality of circular cut outs formed therein for supporting cup cakes therein;

a cover including a top face and a side wall integrally coupled to a periphery of the top face of the cover and depending downwardly therefrom for defining an interior space, open bottom and lower peripheral edge, the cover including a peripheral protrusion integrally formed in an interior surface of the side wall thereof adjacent to the lower peripheral edge for releasably coupling with the peripheral groove of the base thereby affording a hermetically sealed compartment; and a handle for carrying purposes;

wherein the tray has a removable plate secured thereto for supporting the cup cakes.

11. A cup cake riddle as set forth in claim 10 wherein the handle is coupled to the cover.

12. A cup cake riddle as set forth in claim 10 wherein the handle is rotatably coupled to the riddle.

13. A cup cake riddle as set forth in claim 10 wherein the handle has a U-shaped configuration.

14. A cup cake riddle as set forth in claim 10 wherein at least one tray is situated on the base for supporting additional cup cakes, the tray having a plurality of legs coupled thereto towards corners of the tray.

15. A cup cake riddle as set forth in claim 10 wherein a plurality of trays are included that are stacked on the base.

16. A cup cake riddle as set forth in claim 15 wherein each of the trays has a pair of diagonally opposed L-shaped protrusions integrally coupled to a top face thereof and extending upwardly therefrom, each leg having a constant L-shaped horizontal cross-section.

* * * * *